US005493823A

United States Patent [19]

Baldi

[11] Patent Number: 5,493,823

[45] Date of Patent: Feb. 27, 1996

[54] THREE DIMENSIONAL STRINGER PADS FOR CARPETED STAIRCASES

[76] Inventor: John Baldi, 1518 12th St., West Babylon, N.Y. 11704

[21] Appl. No.: 341,423

[22] Filed: Nov. 17, 1994

[51] Int. Cl.[6] ..... E04F 11/00

[52] U.S. Cl. ..... 52/191; 52/182; 52/184; 52/188; 52/190

[58] Field of Search ..... 52/188, 190, 191, 52/184, 185, 186, 182, 746; 16/1 R

[56] References Cited

U.S. PATENT DOCUMENTS

| | | | |
|---|---|---|---|
| 3,755,981 | 9/1973 | West | 52/184 |
| 3,789,556 | 2/1974 | Skinner | 52/191 X |
| 4,004,384 | 1/1977 | Hood | 52/188 |
| 4,797,170 | 1/1989 | Hoopengardner | 52/746 X |
| 4,875,315 | 10/1989 | Champagne | 52/191 X |

*Primary Examiner*—Carl D. Friedman
*Assistant Examiner*—W. Glenn Edwards
*Attorney, Agent, or Firm*—Galgano & Burke

[57] ABSTRACT

A three dimensional stringer pad affixed to the stringers of a staircase prior to applying carpet. The stringer pad is dimensioned to substantially completely overlay the stringer, has an inner flat surface which lies substantially flush on the stringer and has an outer surface which billows out from the stringer to create a three dimensional surface upon which carpet is later applied. Prior to applying carpet to the stringers of the staircase, the three dimensional stringer pads are applied to the stringers using nails or any suitable adhesive. Carpet is then applied to the stringers with the stringer pads interposed between the carpet and the stringers. Due to the billowing surface of the stringer pads, the carpeted stringers are provided with a three dimensional look which is aesthetically pleasing and which serves to further define the risers and treads of the staircase. Preferred aspects of the invention include constructing the stringer pads from inexpensive polyurethane foam or equivalent material. When constructed from such a material, the pads may be easily trimmed by the installer to assure a good fit on the stringers. The pads may be constructed in several "standard sizes" and trimmed by the installer at the time of installation. The pads may be used on upper or lower stringers by rotating the pads 180°.

10 Claims, 3 Drawing Sheets

THREE DIMENSIONAL STRINGER PADS FOR CARPETED STAIRCASES

BACKGROUND OF THE INVENTION

1. Field of the Invention

The invention relates to carpeted staircases. More particularly, the invention relates to a three dimensional pad which is placed on stringer portions of a staircase prior to carpeting the staircase. After the staircase is carpeted, the stringer portions of the staircase exhibit a modern billowing appearance.

2. State of the Art

A staircase 10 such as the one shown in FIG. 1 is composed of a number of treads 12 which are interspaced by a corresponding number of risers 14. On either side of the treads 12 and risers 14 is a stringer 16, 18. The treads 12 and risers 14 are typically arranged at right angles to each other as shown, but those skilled in the art will realize that the angle between treads and risers may vary from 90°. In general, adjacent treads and risers have surfaces which lie in intersecting planes and the stringers have surfaces which lie in a plane which intersects the planes of both the treads and the risers. As seen in FIG. 1, one stringer 16 (an upper stringer) is located above the treads 12 and the other stringer 18 (a lower stringer) is located below the treads 12. However, those skilled in the art will appreciate that both stringers may be located either above or below the treads depending on various architectural considerations. The stringers 16, 18 have a generally toothed profile. In a staircase having risers and treads which are at right angles to each other, the stringers have a profile which resembles a number of right triangles joined in a line at their hypotenuses. Each right angle in the stringer corresponds to the intersection of a corresponding tread and riser. In some staircases, the treads extend slightly beyond the risers to form a lip. The tread lip may be located forward of the riser as indicated by **12*a* in FIG. 1 or rearward of the riser as indicated by 12*b*, or both. When the staircase has tread lips, the stringers will often be provided with corresponding notches, e.g. 16*a*, 18*a*** for each lip the stringer intersects.

It is, of course, well known to apply carpeting to a staircase. Traditionally, a carpet runner is applied to a central portion of the treads and risers leaving the stringers and side portions of the treads and risers uncarpeted. In modern wall-to-wall carpeting, it is known to apply carpeting across the complete width of the risers and treads. In some cases, the stringers are also carpeted by cutting pieces of carpeting to conform to the stringers. Whereas the traditional carpeting of staircases left the treads and risers well defined, modern wall-to-wall techniques tend to obscure the treads and risers. Staircases carpeted with modern wall-to-wall techniques have an aesthetically bland two-dimensional appearance and can also be hazardous insofar as the treads and risers are so obscured to the eye.

SUMMARY OF THE INVENTION

It is therefore an object of the invention to provide methods and means for carpeting a staircase which yield an aesthetically pleasing appearance.

It is also an object of the invention to provide methods and means for carpeting a staircase which accentuate the location of risers and treads.

It is another object of the invention to provide methods and means for carpeting a staircase which enhance the safety of the staircase.

It is still another object of the invention to provide methods and means for carpeting a staircase which yield a three dimensional appearance.

In accord with these objects which will be discussed in detail below, the present invention provides a three dimensional stringer pad which is affixed to the stringers of a staircase prior to applying carpet. The stringer pad is dimensioned to substantially completely overlay the stringer, has an inner flat surface which lies substantially flush on the stringer and has an outer surface which billows out from the stringer to create a three dimensional surface upon which carpet is later applied. Prior to applying carpet to the stringers of the staircase, the three dimensional stringer pads are applied to the stringers using staples or any suitable adhesive. Carpet is then applied to the stringers with the stringer pads interposed between the carpet and the stringers. Due to the billowing surface of the stringer pads, the carpeted stringers are provided with a three dimensional look which is aesthetically pleasing and which serves to further define the risers and treads of the staircase.

Preferred aspects of the invention include constructing the stringer pads from inexpensive polyurethane foam or equivalent material. When constructed from such a material, the pads may be easily trimmed by the installer to assure a good fit on the stringers. The pads may be constructed in several "standard sizes" and trimmed by the installer at the time of installation. The pads may be used on upper or lower stringers by rotating the pads 180°.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
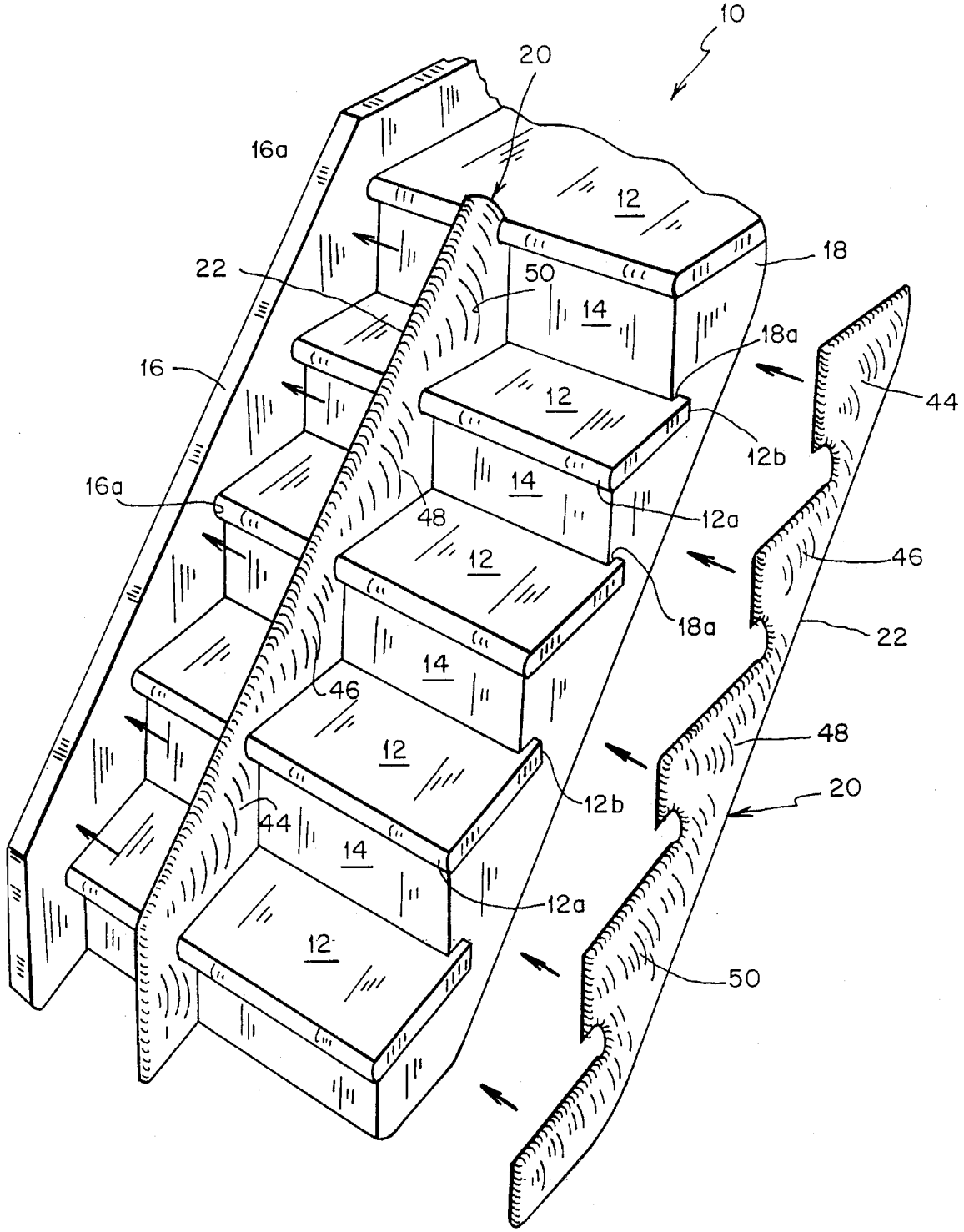
FIG. 1 is a perspective view of a prior art staircase having one upper stringer and one lower stringer showing an upper and lower three-dimensional stringer pad embodying the present invention being mounted thereon.

Referring now to FIGS. 1, 2, 3 and 5 therein illustrated are three dimensional stringer pads 20 according to the invention which preferably comprise a unitary piece of polyurethane foam of predetermined length. The presently preferred embodiment contemplates a length of approximately forty-eight inches. The perimeter of the pad 20 is dimensioned to approximate the shape of a staircase stringer. The pad therefore has one long straight edge 22 and a series of right angled edges 24, 26, 28, 30, 32, 34, 36, 38, etc. resulting in a series of substantially triangular portions each of which are defined by a pair of adjacent right angled edges, e.g. 24, 26, and a portion of the long straight edge 22. A lower (or inner)

surface 40 of the pad is substantially planar and an upper (or outer) surface 42 is provided with billowing contours. The billowing contours rise a couple of inches (preferably 1–3 inches) from adjacent right angled edges, e.g. 24, 26 and a portion of the long straight edge 22 to provide a series of substantially triangular pillow-like mounds 44, 46, 48, 50. It will be appreciated that the adjacent right angled edges intersect at outer right angles 25, 29, 33, 37 and at inner right angles 27, 31, 35. Notches 27*a*, 31*a*, 35*a* may be provided at the inner right angle intersections of edged to accommodate tread lips of a staircase. These notches may be preformed in the stringer pad or may be cut by the installer prior to installing the pads. It will be appreciated that the right angles referred to herein assume that the pad 20 will be used on a staircase where the treads and risers are at right angles to each other. In general, the angles need not be right angles, but they should be angles which match the angle formed by the treads and risers of the staircase upon which the pads will be used.

Figure 2:
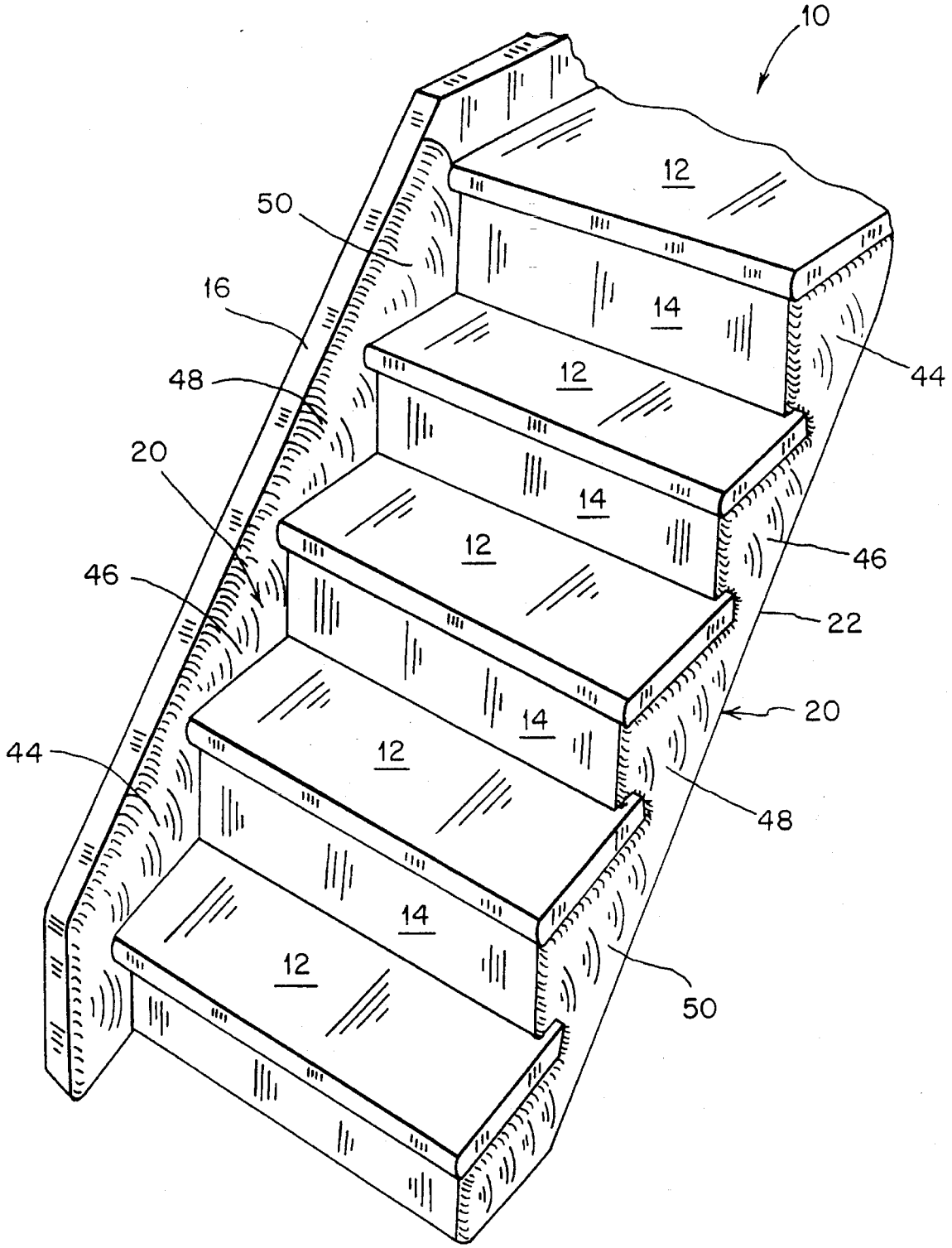
FIG. 2 is a view similar to FIG. 1 showing the stringer pads according to the invention attached to the staircase of FIG. 1.
Figure 3:
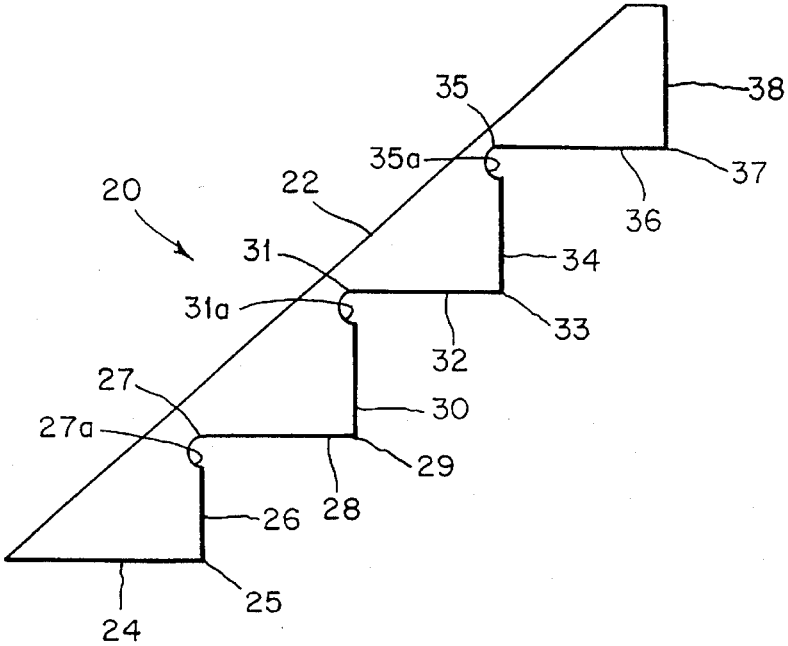
FIG. 3 is a plan view of the upper three dimensional stringer pad according to the invention.
Figure 4:
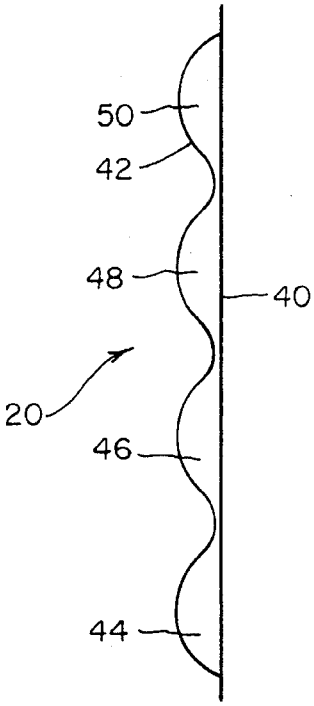
FIG. 4 is a side elevational view of the stringer pad of FIG. 3.
Figure 6:
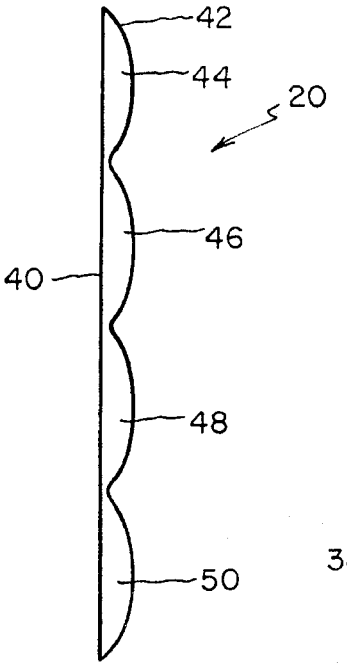
FIG. 6 is a side elevational view of the stringer pad of FIG. 5.
Figure 5:
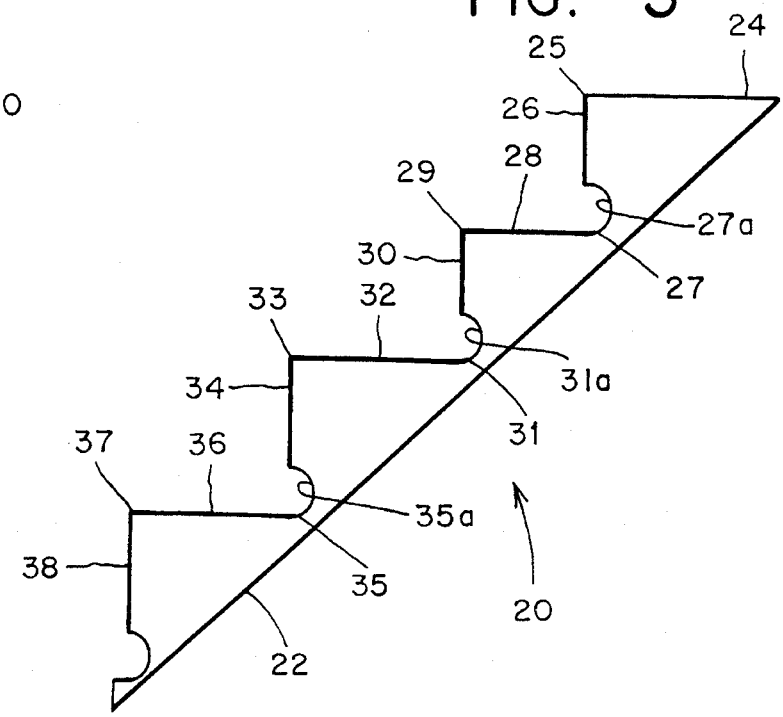
FIG. 5 is a plan view of the lower three-dimensional stringer pad according to the invention.

FIGS. 1 and 2 show how the stringer pads 20 are applied to the stringers 16, 18 of a conventional staircase 10. From these Figures, it can be seen that the same kind of stringer pad 20 can be used on either the upper stringer 16 or the lower stringer 18 by rotating the pad 180°. The stringer pad 20 is applied to the surface of a stringer 16, 18 such that its planar surface 40 lies substantially flush against the surface of the stringer 16, 18. The pads 20 may be applied to the stringers with any suitable adhesive or with nails, staples, etc.

FIG. 2 shows the stringer pads 20 installed via staples on the stringers 16, 18 of the staircase 10. After the pads 20 have been installed as shown in FIG. 2, carpeting would be applied over the stringer pads using carpet staples. The steps and rises would then be finished with carpeting in a conventional manner.

There have been described and illustrated herein a three dimensional stringer pad and a method for its use. While particular embodiments of the invention have been described, it is not intended that the invention be limited thereto, as it is intended that the invention be as broad in scope as the art will allow and that the specification be read likewise. Thus, while particular materials have been disclosed, it will be appreciated that other materials could be utilized. For example, while the preferred material is polyurethane foam, and relatively rigid material could be used. Also, while particular dimensions have been shown, it will be recognized that other dimensions could be used with similar results obtained. In particular, while the stringer pads have been described and shown as covering a substantial length of the stringer, it is possible to provide many small stringer pads, each of which covers only a portion of the stringer which lies between an adjacent tread and riser. Moreover, while particular configurations have been disclosed in reference to angles of the edges of the pad which abut the treads and risers, it will be appreciated that other angles could be used as well. It will therefore be appreciated by those skilled in the art that yet other modifications could be made to the provided invention without deviating from its spirit and scope as so claimed.

What is claimed is:

1. A three dimensional stringer pad for use in carpeting a staircase which has a tread with a tread surface lying in a first plane and a riser with a riser surface lying in a second plane with a stringer abutting the tread and riser and having a stringer surface lying in a third plane which intersects the first and second planes, said stringer pad comprising:

a relatively rigid material having a profile which substantially matches the profile of the stringer, one side of said relatively rigid material having a substantially planar surface and the other side of said relatively rigid material having a billowing surface such that when said planar surface is placed against the surface of the stringer, said billowing surface lies between the first and second plane and projects outwardly from said third plane and carpeting applied to the stringer is caused to billow between the tread and riser outwardly from said stringer surface.

2. A stinger pad according to claim 1, for use in carpeting a staircase which has a plurality of treads and risers wherein said other side of said relatively rigid material has a plurality of billows arranged such that when said planar surface is placed against the surface of the stinger, each of said plurality of billows lies between an adjacent tread and riser and projects outwardly from said third plane.

3. A stringer pad according to claim 1, wherein said relatively rigid material is polyurethane foam.

4. A stringer pad according to claim 1, wherein said relatively rigid material has a first edge and a second edge such that when said planar surface is placed against the surface of the stringer, said first edge lies substantially parallel to the first plane and said second edge lies substantially parallel to the second plane.

5. A stringer pad according to claim 2, wherein said relatively rigid material is polyurethane foam.

6. A stringer pad according to claim 4, wherein said first edge is provided with a notch for receiving a portion of a tread.

7. A three dimensional stringer pad for use in carpeting a staircase which has a plurality of adjacent treads and risers which are substantially orthogonal to each other with a stringer abutting the treads and risers having a stringer surface lying in a third plane, said stringer surface being substantially orthogonal to the treads and risers, said stringer pad comprising:

a length of relatively rigid material having a generally toothed profile comprised of a plurality of first and second substantially orthogonal edges, said material having a first substantially planar surface and a second surface which has a plurality of billows, each billow lying between a first and second substantially orthogonal edge and projecting outwardly from said third plane, such that when said planar surface is placed against the surface of the stringer, said plurality of first and second substantially orthogonal edges substantially abut respective treads and risers and carpeting applied to the stringer is caused to billow between the treads and risers outwardly from stringer surface.

8. A stringer pad according to claim 7, wherein said relatively rigid material is polyurethane foam.

9. A stringer pad according to claim 7, wherein each of said first edges is provided with a notch for receiving a portion of a tread.

10. A method for applying carpet to the stinger of a staircase having at least one tread and one riser, said method comprising:

applying a stinger pad to the stinger, the stinger pad having a substantially flat surface which abuts the stringer and a billowing surface which lies between the tread and riser and projects outwardly in a third plane when the stringer pad is applied to the stringer; and applying carpet to the stringer such that the stringer pad is interposed between the carpet and the stringer such that the carpet billows out from the stringer between the tread and riser and projects outwardly from said stringer surface.

* * * * *